US007786862B1

(12) United States Patent
Campbell

(10) Patent No.: US 7,786,862 B1
(45) Date of Patent: Aug. 31, 2010

(54) REMOTE MAIL INDICATOR

(76) Inventor: Eugene L. Campbell, 5328 Lennon Rd., Swartz Creek, MI (US) 48473

( * ) Notice: Subject to any disclaimer, the term of this patent is extended or adjusted under 35 U.S.C. 154(b) by 322 days.

(21) Appl. No.: 11/900,289

(22) Filed: Sep. 11, 2007

Related U.S. Application Data

(60) Provisional application No. 60/843,575, filed on Sep. 11, 2006.

(51) Int. Cl.
*G08B 13/14* (2006.01)
*G08B 1/08* (2006.01)

(52) U.S. Cl. ..... 340/569; 340/539.1; 340/539.14; 340/539.16; 340/539.17; 340/545.6

(58) Field of Classification Search ..... None
See application file for complete search history.

(56) References Cited

U.S. PATENT DOCUMENTS

| | | | | |
|---|---|---|---|---|
| 3,611,333 | A * | 10/1971 | Conigliaro | 340/539.14 |
| 4,520,350 | A * | 5/1985 | Huang | 340/569 |
| 4,651,135 | A | 3/1987 | Duhaime et al. | |
| 4,868,543 | A * | 9/1989 | Binkley | 340/569 |
| 5,023,595 | A * | 6/1991 | Bennett | 340/569 |
| 5,036,310 | A * | 7/1991 | Russell | 340/569 |
| 5,060,854 | A | 10/1991 | Armstrong | |
| D338,632 | S | 8/1993 | Colberg | |
| 5,239,305 | A * | 8/1993 | Murphy et al. | 340/539.1 |
| 5,247,282 | A * | 9/1993 | Marshall | 340/569 |
| D350,298 | S | 9/1994 | Horton | |
| 5,440,294 | A * | 8/1995 | Mercier et al. | 340/569 |
| 5,950,919 | A | 9/1999 | Adams | |
| 6,046,675 | A * | 4/2000 | Hanna | 340/569 |
| 6,114,959 | A * | 9/2000 | Bennett | 340/569 |
| 6,275,154 | B1 * | 8/2001 | Bennett et al. | 340/569 |
| 6,459,375 | B1 * | 10/2002 | Wallace | 340/569 |
| 6,694,580 | B1 * | 2/2004 | Hatzold | 232/36 |
| 6,831,558 | B1 * | 12/2004 | Andrew | 340/539.2 |
| 7,061,377 | B1 * | 6/2006 | Kraus | 340/545.6 |
| 7,506,796 | B1 * | 3/2009 | Hanna | 232/36 |
| 2004/0212502 | A1 * | 10/2004 | Dalgaard | 340/569 |
| 2006/0144918 | A1 * | 7/2006 | Hutchinson | 232/35 |

* cited by examiner

*Primary Examiner*—Julie Lieu
(74) *Attorney, Agent, or Firm*—Montgomery Patent and Design; Robert C. Montgomery; Joseph T. Yaksich

(57) ABSTRACT

A method and system for remote notification of arrival of postal mail in a mailbox through a wireless transmitter and receiver, is herein disclosed. The system consists of a battery-powered motion sensor placed within an upper back portion of a standard, approved mailbox thereby a fastening means. When the mailbox door opens, the motion sensor is activated and automatically generates and transmits a wireless signal to a receiver located within a pre-determined proximity. The receiver is capable of providing both an audible and visual signal.

18 Claims, 5 Drawing Sheets

REMOTE MAIL INDICATOR

RELATED APPLICATIONS

The present invention was first described in and claims the benefit of Disclosure Document No. 591993 filed on Dec. 21, 2005 and U.S. Provisional Patent No. 60/843,575 filed on Sep. 11, 2006. There are no previously filed, nor currently any co-pending applications, anywhere in the world.

FIELD OF THE INVENTION

The present invention relates generally to a method and system for the remote notification of the arrival of postal mail in a mailbox some distance away from a structure and, more particularly, to when the mailbox door opens to receive delivered mail that a motion sensor is activated and in turn automatically transmits a wireless signal to a receiver located within a pre-determined proximity.

BACKGROUND OF THE INVENTION

A daily routine in almost every residence across the country is the waiting for the U.S. mail postal delivery. This routine is especially time wasting in households that have a curbside or rural mailbox. The resident must watch for the mail delivery and see if anything is placed in the box. If the person does not watch and just waits until the normal delivery time has passed, they are still not sure if anything was delivered or not other than by taking a trip to the mailbox. This is especially time consuming in hot, cold, rain or snow conditions. Accordingly, there exists a need for a means by which the delivery of mail to a remote mailbox can be visually or audibly indicated to the resident located in a separate structure. The development of the invention herein described fulfills this need.

The mail indication system provides for the wireless notification of mail delivery to a curbside, apartment/office complex or rural mailbox. The system consists of a battery-powered transmitter that is mounted inside of a conventional mailbox. The transmitter is held in place with double-sided tape, or other suitable fastening means. The transmitter is activated by the use of a motion sensor switch that is automatically activated whenever the mailbox door is opened. The alerting system also relies on a receiver that is located inside of a remote structure or residence, up to several hundred feet away. The receiver has an indicator light and an audible alarm that sounds when the mail is delivered. A switch is provided to reset the system for the next day's mail. The use of the innovative system provides for the remote notification of mail delivery in an efficient manner.

Several attempts have been made in the past to provide remote indication of the receipt of mail within a mailbox, particularly for those residences that are far away from the mailbox location. U.S. Pat. No. 6,694,580 in the name of Hatzold discloses a mail notification system comprising an activator attachment to an inner surface of a mailbox that opens to an extended position and emits radio waves to a receiver. Said receiver has a speaker to emit sounds and is attached to a word display. Unfortunately, the Hatzold device does not utilize a motion sensing device integral to a transmitter that is selectively installed with a mounting mechanism thereto a inner surface of a mailbox.

U.S. Pat. No. 5,950,919 issued in the name of Adams teaches a remote mail delivery system for signaling to the user when mail is being delivered by using an LED display or speaker and a pressure sensitive transmitter on the cornice of the floor of the mailbox. The present invention utilizes a different means of detection and is designed to be mounted on the sides or rear face of the interior of the mailbox.

U.S. Pat. No. 6,459,375 issued in the name of Wallace describes an electronic mail sensor for informing a user that something has been put into a mailbox. Unfortunately, the Wallace device differs from the present invention in that the transmitter device is installed therein the mailbox with a clip member as opposed to which enables the transmitter in the present invention to be mounted along any interior face within the mailbox, such that the motion sensing device is positioned to detect a mail delivery event. Additionally, there are no provisions in the Wallace device to provide a resetting function to deactivate an audible or visual indication of said mail delivery event.

U.S. Pat. No. 5,060,854 issued in the name of Armstrong discloses a remote indicator system for determining at a remote location when incoming mail is present in a mailbox, comprising a light port that admits ambient light to shine on a photodetector on the bottom of the mailbox, which produces a signal when no mail is present and a signal when the light is interrupted, thereby indicating mail has arrived. Another photodetector disables the first signal when the ambient light is below a given intensity and a switching mechanism is attached to a manually operable flag for determining the difference between incoming and outgoing mail. Unfortunately, the Armstrong device differs in scope from the present invention in that the sensing device utilizes different principles and is mounted in a different location.

None of the prior art particularly describes a device to effectively notify a user of delivery and/or receipt of mail in a mailbox at a remote location. Accordingly, there is a need for a means by which the a sensing device is positioned such that it detects the presence of a delivery of mail, generates a detection signal, transmits said detection signal, receives said detection signal at a remote location, and alerts said user via a audible alarm and/or a visual display.

SUMMARY OF THE INVENTION

In view of the foregoing disadvantages inherent in the prior art, it has been observed that there is need of a system to alert a user at a remote location of a delivery of mail within a mailbox, particularly when such a remote location is in a rural location, an apartment complex, or when multiple deliveries are made, among other such locations.

It has further been observed that there is a need for a system that notifies said user via an audible alarm and/or a visual display.

The object of the present invention is to provide such a system to include a transmitter mounted thereto an interior surface of a mailbox with a first mounting means and having an integral motion sensing means, said motion sensing means generating a detection signal, said transmitter transmitting said detection signal over a radiofrequency, a receiver receiving said detection signal and mounted to a structure at a remote location via a second mounting means; and said receiver generating an audio alarm and visual display.

Another object of the present invention is to provide a transmitter comprising a hand-held rectangular plastic first enclosure, a first battery compartment located along a front surface, a motion sensing device located along a front surface, a timing circuit, a power source in electrical communication therewith said transmitter and said motion sensing device, a first on/off switch located along a front surface for controlling power thereto said transmitter and said motion sensing device, a transmitting antenna located thereon a top surface, and an indication sticker for placement on an exterior face of said mailbox. Such a transmitter comprises said first enclosure which provides a protection means to internal electrical and electronic components and wherein said transmitting antenna transmits said detection signal in a radiating pattern at a transmitting range.

A further object of the present invention provides for said first enclosure to be manufactured out of an ultraviolet radiation (UV)-resistant plastic.

A further object of the present invention provides for said motion sensing device comprising a photoelectric sensing means; wherein said motion sensing device is positioned such that it is exposed to an incoming mail path within said interior of said mailbox.

Yet another object of the present invention provides for said transmitting antenna to further comprise a coiled wire-type which is either routed on an inside of said mailbox or, alternately, routed on an exterior of said mailbox therethrough an opening on said mailbox for increasing said transmitting range.

Yet another object of the present invention provides said first mounting means to further comprise a male mounting bracket affixed thereto a rear surface of said transmitter, a female mounting bracket for removably receiving said male mounting bracket, and an attachment means on a rear surface of said female mounting bracket. Such an attachment means removably attaches said female mounting bracket thereto said interior face of said mailbox, either on a side location or a rear location.

Still yet another object of the present invention is to provide a receiver further comprising a hand-held rectangular plastic second enclosure a second battery/compartment located along a front surface, an alarm speaker located along a front surface, an indicating light located along a front surface, a reset pushbutton located along a front surface, a receiving antenna located on a top surface, a first power source in electrical communication therewith said transmitter and said motion sensing device and, a second on/off switch for controlling power thereto said receiver alarm speaker, indicating light, and reset button.

Said alarm speaker and indicating light is designed to be activated upon receipt of said detection signal by said receiving antenna and said alarm speaker provides said audible indication and said indicating light provides said visual indication of received detection signal. Said reset pushbutton provides a deactivation means to said alarm speaker and said indicating light, such that a first activation of the reset pushbutton will silence said alarm speaker and a second activation will extinguish said indicating light, thus resetting said receiver for further activation during a subsequent mail delivery cycle.

The receiver further comprises a second mounting means for removably mounting therein or thereon an interior of a residence such as on a wall, located on a countertop, or a similar fixed location or, alternately, a portable mounting means, such as within a vehicle or worn by a user.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
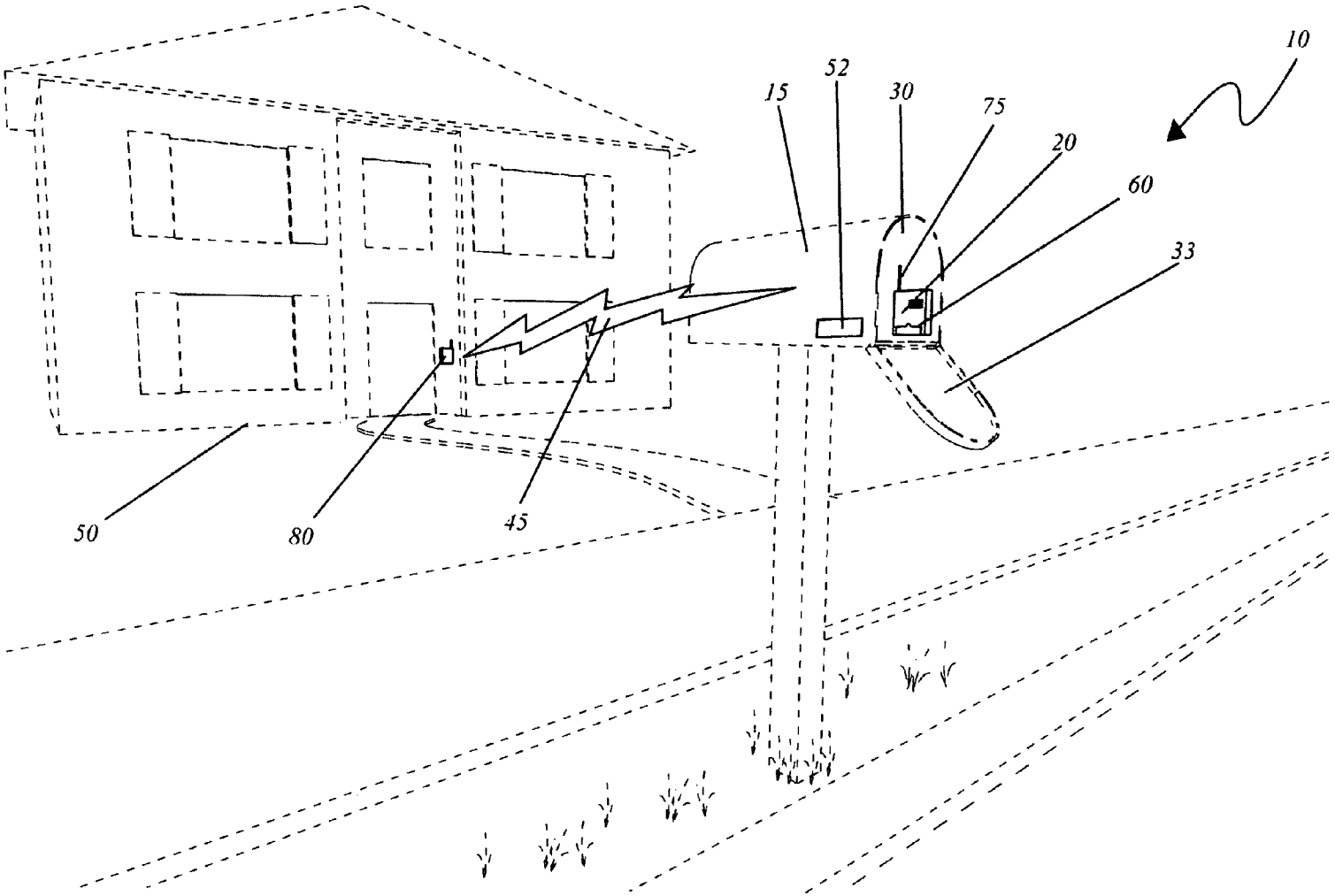
FIG. 1 is an environmental view of a remote mail indicator 10, according to a preferred embodiment of the present invention; and, FIG. 2*a* is a front perspective view of a RF transmitter portion 20 of a remote mail indicator 10, according to a preferred embodiment of the present invention; and, FIG. 2*b* is a rear perspective view of a RF transmitter portion 20 of a remote mail indicator 10, according to a preferred embodiment of the present invention; and, FIG. 3 is a front perspective view of an RF receiver portion 80 of a remote mail indicator 10, according to a preferred embodiment of the present invention; and, FIG. 4 is an electrical block diagram depicting the major components of the remote mail indicator 10, according to a preferred embodiment of the present invention.

| | |
|---|---|
| 10 | remote mail indicator |
| 15 | mailbox |
| 20 | radio frequency (RF) transmitter |
| 25 | male mounting bracket |
| 30 | side or rear surface |
| 33 | mailbox door |
| 35 | female mounting bracket |
| 36 | attachment means |
| 40 | motion sensing device |
| 45 | coded RF signal |
| 50 | residence |
| 52 | indication sticker |
| 53 | exterior face |
| 55 | first enclosure |
| 60 | first battery/compartment |
| 65 | front face |
| 70 | first on/off switch |
| 75 | transmitting antenna |
| 80 | RE receiver |
| 85 | second enclosure |
| 90 | second battery/compartment |
| 95 | second on/off switch |
| 100 | alarm speaker |
| 105 | indicating light |
| 110 | receiving antenna |
| 115 | reset pushbutton |
| 120 | first battery |
| 125 | first output signal |
| 130 | timing circuit |
| 135 | coded transmitter |
| 140 | coded receiver |
| 145 | second output signal |
| 150 | latching relay circuit |
| 155 | second battery |

DETAILED DESCRIPTION OF THE PREFERRED EMBODIMENT

The best mode for carrying out the invention is presented in terms of its preferred embodiment, herein depicted within FIGS. 1 through 4. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a system for a remote mail indicator (herein described as the "system") 10, which provides a means for a method and system for remote notification of arriving postal mail in a mailbox 15 some distance away through a wireless RF transmitter 20 and RF receiver 80. The system 10 consists of a battery-powered 120 motion sensor 40 placed within an upper back portion of a standard, approved mailbox 15. When the mailbox door 33 opens, the motion sensor 40 is activated and automatically generates and transmits a wireless signal 45 to an RF receiver 80 located within a residence 50. The RF receiver 80 is capable of providing both an audible 100 and a visual 105 signal.

Referring now to FIG. 1, an environmental view of the system 10, according to the preferred embodiment of the present invention, is disclosed. The mailbox 15 is depicted as a rural, curbside type mailbox typically located in a user's front yard for purposes of illustration. However, other type mailboxes such as house mounted mailboxes, apartment style gang mailboxes, or gang mounted rural mailboxes mounted at an end of a street would work equally as well with the system 10 and as such, should not be interpreted as a limiting factor of the present invention. An RF transmitter 20 is mounted on the inside of the mailbox 15 as shown. The RF transmitter 20 comprises a hand-held rectangular plastic enclosure providing a protection means to internal electrical and electronic components. The RF transmitter 20 attaches thereto an inner side or rear surface 30 of the mailbox 15 via a male mounting bracket 25 and a female mounting bracket 35. The removable nature of the male mounting bracket 25 allows a user to remove the RF transmitter 20 by simply lifting off the female mounting bracket 35 to aid in and facilitate periodic battery replacement.

A motion sensing device 40 is located on a front vertical surface of the RF transmitter 20. It is envisioned that a photoelectric sensing means would be utilized due to its low power requirements, although those skilled in the art will realize that other motion sensing teachings such as infrared, ultrasonic, capacitive, radiofrequency (RF), and the like would work equally as well in this application and, as such, should not be interpreted as a limiting factor of the present invention 10. Upon sensing motion associated with the placement of mail or postal items inside of the mailbox 15, the RF transmitter 20 emits a coded RF signal 45 in a radiating pattern which is received by the RF receiver 80 (see FIG. 3) located in a residence 50. It is envisioned that the radiating distance of the coded RF signal 45 will be governed by various factors such as environmental conditions, transmitting power, transmitter location, receiver location and the like; however, a range of 300 feet is envisioned as practical. Finally, an indication sticker 52 is provided for placement on an exterior face 53 of the mailbox 15 to indicate the presence of the system 10 therewithin to mail carriers.

Figure 2A:
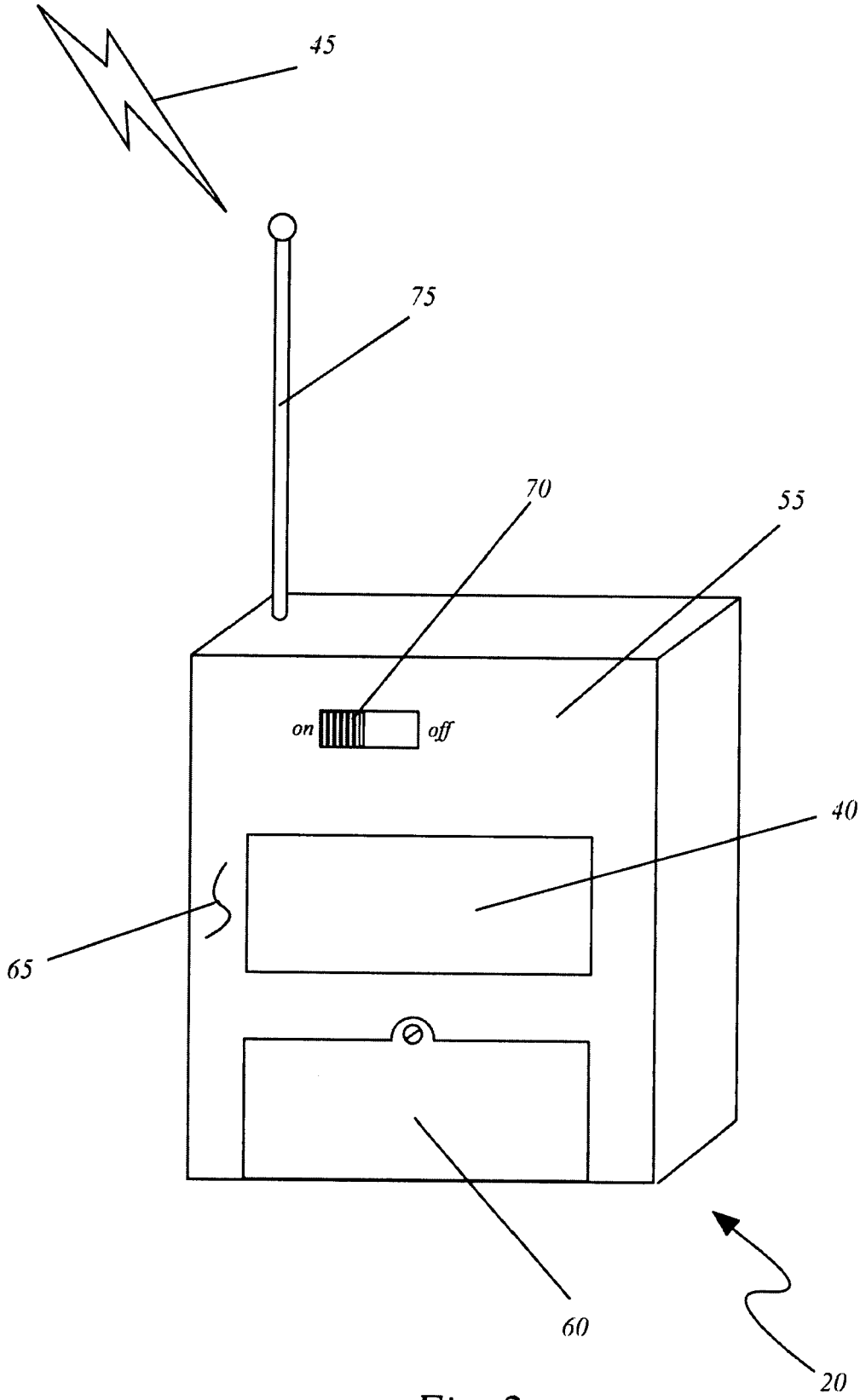
Figure 2B:
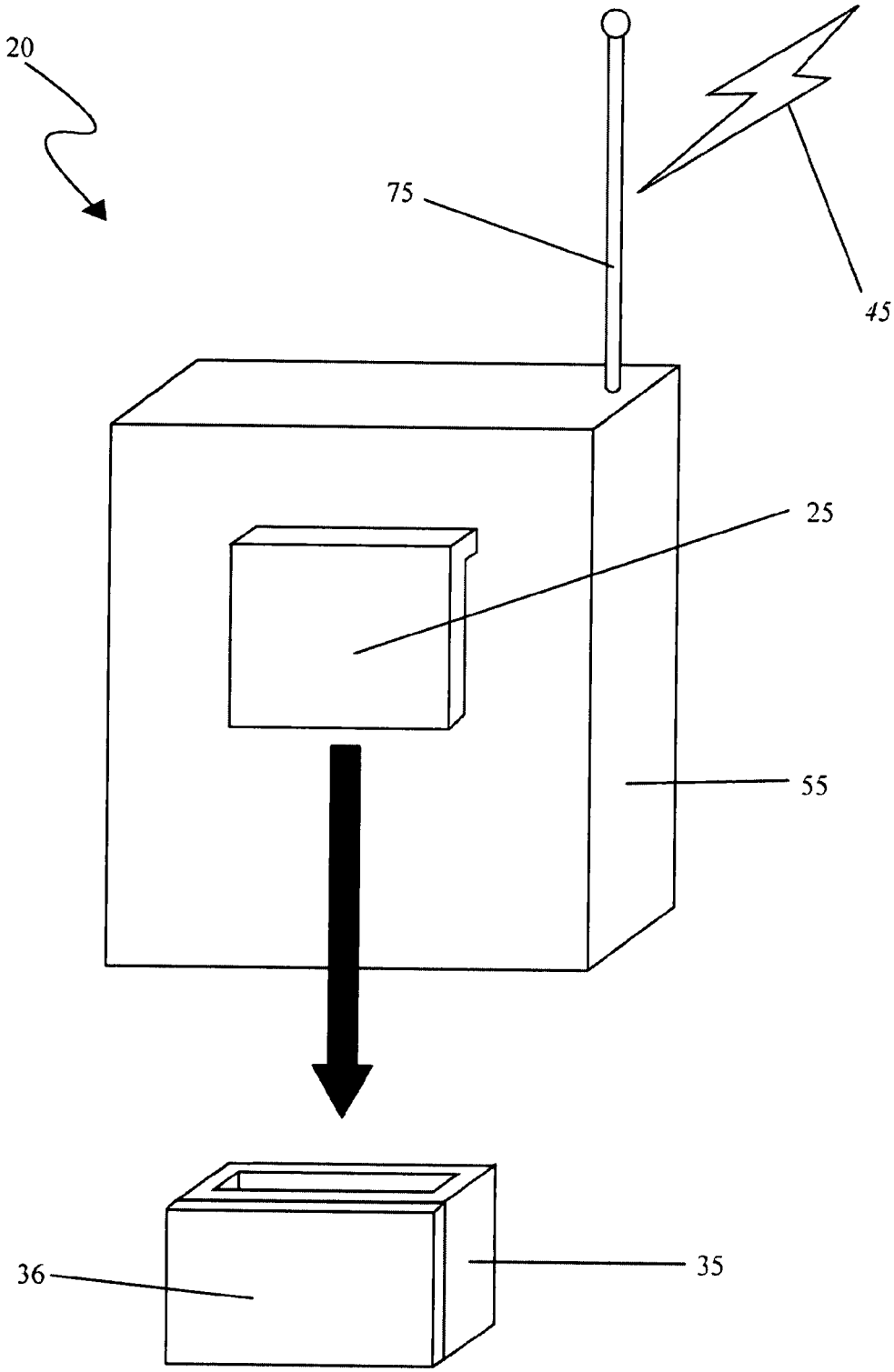

Referring now to FIGS. 2*a* and 2*b*, front and rear perspective views of an RF transmitter portion 20 of the system 10, according to the preferred embodiment of the present invention, are disclosed. The RF transmitter 20 comprises of a first enclosure 55 envisioned to be made of ultraviolet radiation (UV) resistant plastic. Located along a front surface of the RF transmitter 20 are a first battery/compartment 60, a motion sensing device 40, a first on/off switch 70, and a transmitting antenna 75. The first battery compartment cover 60 allows for periodic battery replacement. The motion sensing device 40 is provided and positioned such that it is exposed to the incoming mail path as previously described in FIG. 1. The first on/off switch 70 provides a deactivation means to the RF transmitter 20 enabling deactivation during long periods of non-use such as vacations and the like. The transmitting antenna 75 is envisioned to be a coiled wire-type which may be routed on the inside of the mailbox 15 or on the exterior of the mailbox 15 through the door opening or through another small hole on the mailbox 15 for increased transmitting range.

The RF transmitter 20 provides an attachment means to the mailbox 15 via an integrally molded male mounting bracket 25 and a female mounting bracket 35. The male mounting bracket 25 comprises an "L"-shaped fixture along a rear surface of said first enclosure 55 with a long side thereof extending in a downward direction. The male mounting bracket 25 slidingly engages thereinto the female mounting bracket 35 being inserted thereinto a rectangular female aperture along an upper surface therein said female mounting bracket 35. The female mounting bracket 35 provides an attachment means thereto an inner surface of the mailbox 15 using a suitable fastening means 36, preferably using double-faced foam tape 36; however, may be affixed thereto using screws, rivets, chemical adhesives, or the like, with equal benefit.

Figure 3:
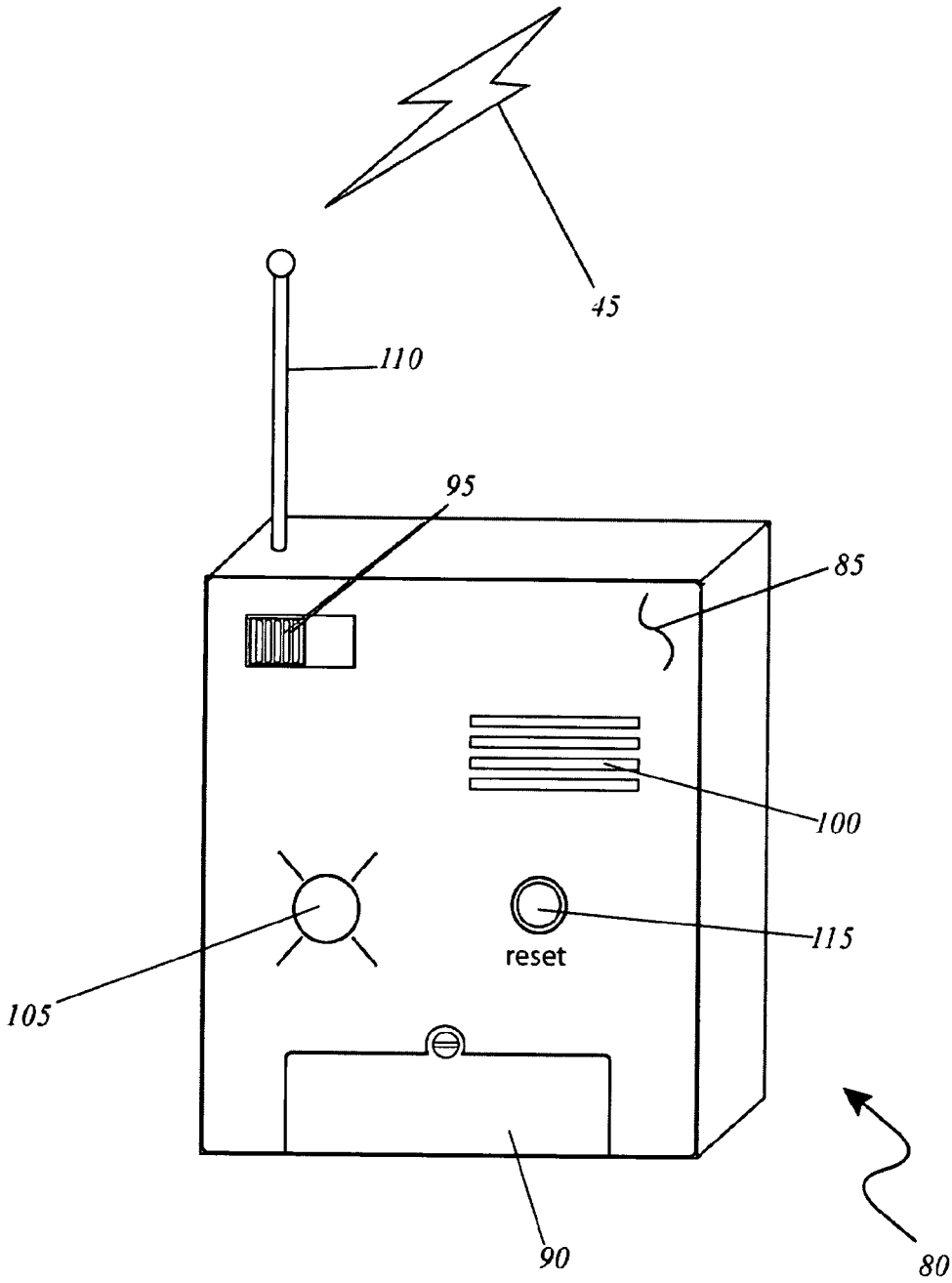

Referring next to FIG. 3, a front perspective view of an RF receiver portion 80 of the system 10, according to the preferred embodiment of the present invention, is disclosed. The RF receiver 80 is envisioned to be located on the interior of a residence 50 such as on a wall, located on a countertop, or the like; however, said RF receiver 80 may also be located portably upon one's person or in proximity to a user while he/she is in or around said residence 50. The RF receiver 80 comprises of a second enclosure 85 envisioned to be made of similar materials and construction as the RF transmitter 20. Mounted along a front surface of said second enclosure 85 are a second battery/compartment 90, a second on/off switch 95, an alarm speaker 100, an indicating light 105, and a reset pushbutton 115. The second battery/compartment 90 is located along a lower edge of the second enclosure 85 to allow for periodic battery 155 replacement. The second on/off switch 95 may deactivate the RF receiver 80 during long periods of non-use such as vacations and the like. The alarm speaker 100 and indicating light 105 provide both visual and audible indication of received mail. Said alarm speaker 100 and indicating light 105 would be activated upon receipt of the coded RF signal 45 by a receiving antenna 110. Thus, both visual and audible indication is provided instantaneously at the precise instant mail or other items are placed in the mailbox 15. Finally, the reset pushbutton 115 provides a deactivation means to the alarm speaker 100 and the indicating light 105. It is envisioned that the first activation of the reset pushbutton 115 will silence the alarm speaker 100 while leaving the indicating light 105 active. A second activation of the reset pushbutton 115 will extinguish the indicating light 105 as well, thus resetting the RF receiver 80 for subsequent activation of the RF receiver 80 on the next mail delivery cycle. In this manner, a user can silence the RF receiver 80 upon initial activation such that sound emitted therefrom the alarm speaker 100 does not become a nuisance, should the user not travel to the mailbox 15 at that time, yet the indicating light 105 remains active to serve as a reminder that mail is ready for retrieval.

Figure 4:
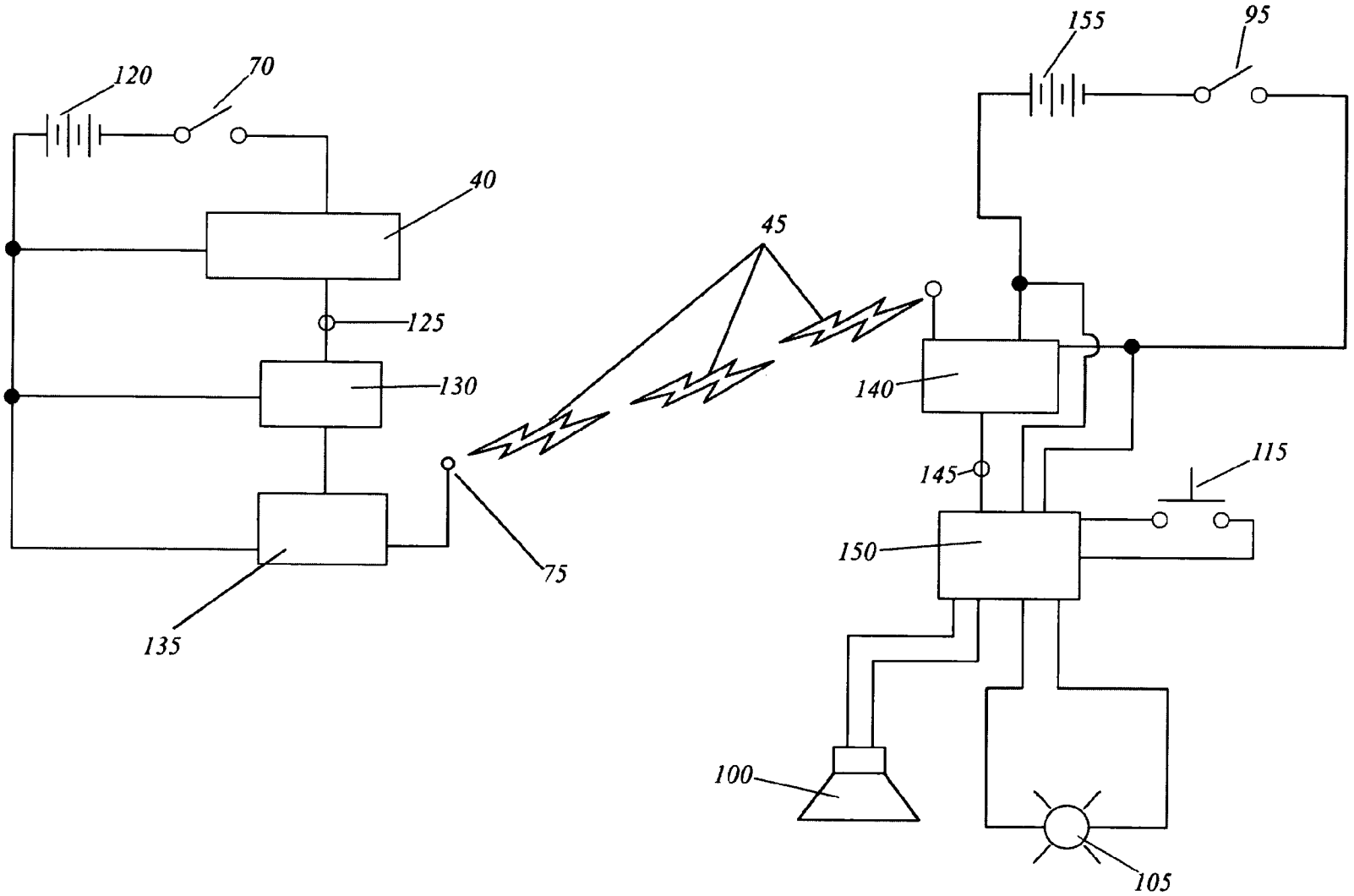

Referring finally to FIG. 4, an electrical block diagram depicting the major components of the system 10, according to the preferred embodiment of the present invention, is disclosed. Power from a first battery 120 is routed through a first on/off switch 70 and onto the motion sensing device 40. As previously mentioned, the motion sensing device 40 can use one of a multitude of technologies. However, in all cases, upon positive activation, a first output signal 125 is sent to a timing circuit 130. The timing circuit 130 sends a multitude of pulses to a coded transmitter 135 to ensure successful transmission. It is envisioned that a quantity of three pulses per activation of the first output signal 125 would ensure successful transmission. The coded RF signal 45 is then transmitted via the transmitting antenna 75. At the opposite end of the matched transmitter/receiver pair, the coded RF signal 45 is intercepted by the receiving antenna 110 which passes the corresponding signal onto a coded receiver 140. In the event of a successful match, a second output signal 145 is generated and passed onto a latching relay circuit 150. A second battery 155 provides power through the second on/off switch 95 to the coded receiver 140 and the latching relay circuit 150. The latching relay circuit 150 receives a signal from the reset pushbutton 115 and controls activation of the alarm speaker 100 and the indicating light 105 in a manner as previously described. The matched and coded nature of the coded RF signal 45 working in conjunction with the coded transmitter 135 and the coded receiver 140 allows multiple RF receivers 80 to be used in a specific common location without interference between said RF receiver units 80. It is also envisioned that the system 10 could be used upon other delivery points such as newspaper boxes, door systems, and the like.

It is envisioned that other styles and configurations of the present invention can be easily incorporated into the teachings of the present invention, and only one particular configuration shall be shown and described for purposes of clarity and disclosure and not by way of limitation of scope. The preferred embodiment of the present invention can be utilized by the common user in a simple and effortless manner with little or no training. After initial purchase or acquisition, the system 10 would be installed by the final user in general accordance with FIGS. 1 through 3.

The method of installing and utilizing the system 10 may be achieved by performing the following steps: mounting the female mounting bracket 35 within a mailbox at a side or rear location using an attachment means such as double-faced tape; installing the RF transmitter 20 inside a mailbox 15 by inserting the male mounting bracket feature 25 thereinto the female mounting bracket 35; placing the RF receiver 80 in a readily accessible location inside of the residence 50; loading a fresh first battery 120 thereinto the RF transmitter 20; loading a fresh second battery 155 therewithin the RF receiver 80; activating the system 10 by switching the first on/off switch 70 and the second on/off switch 95 to the ON position on both the RF transmitter 20 and the RF receiver 80 respectively; and, monitoring a mail delivery event using the present invention 10 in an expected manner.

The system 10 is activated by the postal carrier in a simple and transparent manner when compared to conventional mailboxes not equipped with the system 10. At the point in time, when the mailbox door 33 is opened, the motion sensing device 40 in conjunction with the coded transmitter 135 and the transmitting antenna 75 generates a coded RF signal 45. The coded RF signal 45 is then transmitted outwardly in a radiating pattern where it is received by the receiving antenna 110 on the RF receiver 80. Upon initial reception, both the alarm speaker 100 and the indicating light 105 are activated. The user, located in the residence 50, would be alerted, and activate the reset pushbutton 115 one time to silence the alarm speaker 100 after a trip to the mailbox 15 to retrieve the postal material, the user would return to the residence 50 and activate the reset pushbutton 115 once again to extinguish the indicating light 105. This process completely resets the system 10 and allows for a repeating cycle on a daily basis or as required. The use of the system 10 eliminates unnecessary trips to check on mail delivery. This is viewed as being especially valuable in instances where trips involve a considerable distance, inclement weather, hazardous road conditions, elderly or disabled users, important or high value postal deliveries or a combination thereof.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A system for notification of a postal mail delivery at a remote location comprising:

a wireless transmitter;

a first mounting means for removably attaching said transmitter thereto an interior face of a mailbox;

a motion sensing device integral with said transmitter and in electrical communication therewith;

a receiver comprising an audible indication and a visual indication in electrical communication therewith, further comprising:

a hand-held rectangular plastic second enclosure;

a second battery/compartment located along a front surface;

an alarm speaker located along a front surface;

an indicating light located along a front surface;

a reset pushbutton located along a front surface;

a receiving antenna located on a top surface;

a second power source in electrical communication therewith said receiver; and, a second on/off switch for controlling power thereto said receiver alarm speaker, indicating light, and reset button;

a second mounting means for removably attaching said receiver thereto a structure at said remote location;

wherein said motion sensor senses motion and generates a detection signal;

wherein said transmitter transmits said detection signal as a radiofrequency signal and said receiver receives said detection signal and activates said audible indication and said visual indication;

wherein said alarm speaker and indicating light is activated upon receipt of said detection signal by said receiving antenna and said alarm speaker provides said audible indication and said indicating light provides said visual indication of received detection signal; and wherein said reset pushbutton provides a deactivation means to said alarm speaker and said indicating light, such that a first activation of the reset pushbutton will silence said alarm speaker and a second activation will extinguish said indicating light, thus resetting said receiver for further activation during a subsequent mail delivery cycle.

2. The system of claim 1, wherein said transmitter comprises:

a hand-held rectangular plastic first enclosure;

a first battery compartment located along a front surface;

said motion sensing device located along a front surface;

a timing circuit;

a first power source in electrical communication therewith said transmitter and said motion sensing device;

a first on/off switch located along a front surface for controlling power thereto said transmitter, timing circuit, and motion sensing device; and a transmitting antenna located thereon a top surface;

wherein said first enclosure provides a protection means to internal electrical and electronic components;

wherein said motion sensing device is positioned such that it is exposed to an incoming mail path;

wherein said timing circuit receives said detection signal from said motion sensing device and transmits a pulsed transmission thereto said transmitter; and, wherein said transmitting antenna transmits said detection signal in a radiating pattern at a transmitting range.

3. The system of claim 2, wherein said first enclosure is made of ultraviolet radiation (UV)-resistant plastic.

4. The system of claim 2 wherein said transmitting antenna further comprises a coiled wire-type which is routed on an inside of said mailbox.

5. The system of claim 2 wherein said transmitting antenna further comprises a coiled wire-type which is routed on an exterior of said mailbox therethrough an opening on said mailbox for increasing said transmitting range.

6. The system of claim 1, wherein said first mounting means further comprises:

a male mounting bracket affixed thereto a rear surface of said transmitter;

a female mounting bracket for removably receiving said male mounting bracket; and, an attachment means on a rear surface of said female mounting bracket;

wherein said attachment means removably attaches said female mounting bracket thereto said interior face of said mailbox.

7. The system of claim 2, wherein said motion sensing device comprises a photoelectric sensing means.

8. The system of claim 2, wherein said second mounting means further comprises an interior of a residence.

9. The system of claim 2, wherein said second mounting means further comprises a portable location.

10. A system for notification of a postal mail delivery at a remote location comprising:

a wireless transmitter, further comprising:

a hand-held rectangular plastic first enclosure;

a first battery compartment located along a front surface;

a motion sensing device located along a front surface;

a timing circuit;

a first power source in electrical communication therewith said transmitter and said motion sensing device;

a first on/off switch located along a front surface for controlling power thereto said transmitter, timing circuit, and motion sensing device;

a transmitting antenna located thereon a top surface; and, an indication sticker for placement on an exterior face of said mailbox;

a first mounting means for removably attaching said transmitter thereto an interior face of a mailbox, said first mounting means further comprises:

a male mounting bracket affixed thereto a rear surface of said transmitter;

a female mounting bracket for removably receiving said male mounting bracket; and, an attachment means on a rear surface of said female mounting bracket for removably attaching said female mounting bracket thereto said interior face of said mailbox;

a receiver for wireless transmission comprising an audible indication and a visual indication, further comprising:

a hand-held rectangular plastic second enclosure;

a second battery/compartment located along a front surface;

an alarm speaker located along a front surface;

an indicating light located along a front surface;

a reset pushbutton located along a front surface;

a receiving antenna located on a top surface;

a second power source in electrical communication therewith said receiver;

a second on/off switch for controlling power thereto said receiver alarm speaker, indicating light, and reset button; and, a second mounting means for removably attaching said receiver thereto a structure at said remote location;

wherein said first enclosure provides a protection means to internal electrical and electronic components;

wherein said motion sensing device is positioned such that it is exposed to an incoming mail path, senses motion, and generates a detection signal;

wherein said timing circuit receives said detection signal from said motion sensing device and transmits a pulsed transmission thereto said transmitter; and, wherein said transmitting antenna transmits said detection signal in a radiating pattern at a transmitting range;

wherein said receiver receives said detection signal via said receiving antenna;

wherein said alarm speaker and indicating light is activated upon receipt of said detection signal by said receiving antenna and said alarm speaker provides said audible indication and said indicating light provides said visual indication of received detection signal; and, wherein said reset pushbutton provides a deactivation means to said alarm speaker and said indicating light, such that a first activation of the reset pushbutton will silence said alarm speaker and a second activation will extinguish said indicating light, thus resetting said receiver for further activation during a subsequent mail delivery cycle.

11. The system of claim 10, wherein said first enclosure is made of ultraviolet radiation (UV)-resistant plastic.

12. The system of claim 10, wherein said motion sensing device comprises a photoelectric sensing means.

13. The system of claim 10 wherein said transmitting antenna further comprises a coiled wire-type which is routed on an inside of said mailbox.

14. The system of claim 10 wherein said transmitting antenna further comprises a coiled wire-type which is routed on an exterior of said mailbox therethrough an opening on said mailbox for increasing said transmitting range.

15. The system of claim 10, wherein said second mounting means further comprises an interior of a residence.

16. The system of claim 10, wherein said second mounting means further comprises a portable location.

17. A method of notifying a user at a remote location of a mail delivery event with a mail notification system comprises the following steps:

mounting a female mounting bracket within a mailbox at an interior side or interior rear location using an attachment means;

installing a transmitter inside a mailbox by removably inserting a male mounting bracket feature thereinto said female mounting bracket;

verifying that a motion sensing device integral to said transmitter is positioned such that said mail delivery event is easily detected;

placing a receiver in a readily accessible location of a structure at said remote location;

providing a first power source thereinto said transmitter;

providing a second power source therewithin said receiver;

activating said system by switching a first on/off switch to a first ON position of said transmitter and a second on/off switch to a second ON position of said receiver, respectively;

monitoring said mail delivery event wherein when a mailbox door is opened, said motion sensing device senses a motion and generates a detection signal, said detection signal is transmitted to a timing circuit, said timing circuit transmits said detection signal via a plurality of pulses, said transmitter generates a coded radiofrequency (RF) signal and transmits said coded RF signal thereto a transmitting antenna, said transmitter antenna transmits said coded RF signal outwardly in a radiating pattern where it is received by a receiving antenna on said receiver, and both said alarm speaker and indicating light are activated;

depressing a reset pushbutton on said receiver a first time to silence said alarm speaker;

depressing said reset pushbutton a second time extinguish said indicating light, thereby resetting said system for subsequent mail delivery events.

18. The system of claim 2, further comprising an indication sticker for placement on an exterior face of said mailbox.

* * * * *